US007384670B2

(12) United States Patent
Tani et al.

(10) Patent No.: US 7,384,670 B2
(45) Date of Patent: Jun. 10, 2008

(54) COATING METHOD AND ATOMIZER

(75) Inventors: Shinji Tani, Toyota (JP); Masahito Sakakibara, Toyota (JP); Michio Mitsui, Yokohama (JP); Hiroshi Kobayashi, Yokohama (JP); Kimiyoshi Nagai, Yokohama (JP)

(73) Assignee: Ransburg Industrial Finishing K.K., Kanagawa (JP)

( * ) Notice: Subject to any disclaimer, the term of this patent is extended or adjusted under 35 U.S.C. 154(b) by 806 days.

(21) Appl. No.: 10/811,320

(22) Filed: Mar. 26, 2004

(65) Prior Publication Data

US 2005/0136190 A1 Jun. 23, 2005

(30) Foreign Application Priority Data

Mar. 27, 2003 (JP) ..... 2003-088586

(51) Int. Cl.
*B05D 1/02* (2006.01)

(52) U.S. Cl. ..... 427/421.1; 427/565; 427/600; 239/1; 239/4; 239/7; 239/690; 239/699; 239/700; 239/701; 239/702; 239/703; 239/102.1; 239/102.2

(58) Field of Classification Search ..... 427/565
See application file for complete search history.

(56) References Cited

U.S. PATENT DOCUMENTS 3,908,904 A * 9/1975 Kerner et al. ..... 239/4
4,153,201 A 5/1979 Berger et al. ..... 239/102
4,540,123 A 9/1985 Junger et al. ..... 239/102
4,799,622 A * 1/1989 Ishikawa et al. ..... 239/102.2
4,981,425 A 1/1991 Lierke et al. ..... 425/6
5,122,047 A 6/1992 Bauckhage et al. ..... 425/174.2
6,503,580 B1 * 1/2003 Ruffa ..... 427/600

FOREIGN PATENT DOCUMENTS

JP 43-6907 (B) 3/1968
JP 62-194464 12/1987
JP 09-001004 1/1997

* cited by examiner

*Primary Examiner*—Fred J. Parker
*Assistant Examiner*—Ronald D Lafond
(74) *Attorney, Agent, or Firm*—Kilyk & Bowersox, P.L.L.C.

(57) ABSTRACT

A rotary atomizer (1) has a rotary atomizing head (4) driven by an air motor (2) at a rotational speed of 4,000~5,000 rpm, for example. A coating material is supplied to a central portion of the rotary atomizing head (4) through a paint supply pipe (5). The atomizer (1) further includes a supersonic horn (6) having a vibration plane (6*a*) located adjacent to the outer circumferential perimeter of the rotary atomizing head (4). The vibration plane (6*a*) is an inclined plane gradually increasing its diameter forward. The coating material immediately after spattered from the outer circumferential perimeter of the rotary atomizing head (4) is exposed to supersonic vibration from the vibration plane (6*a*), and it is atomized by the supersonic vibration to particles of a uniform grain size. At the same time, the atomized coating material is driven forward.

4 Claims, 11 Drawing Sheets

COATING METHOD AND ATOMIZER

BACKGROUND OF THE INVENTION

1. Field of the Invention

The present invention relates to a coating method and an atomizer, and more particularly to a coating technique using supersonic vibration.

2. Related Background Art

Some types of atomizers are currently known. They are rotary atomizers configured to atomize a coating material with a bell-shaped rotating member driven at a high speed, spray type atomizers configured to atomize a coating material by expelling it together with air from a nozzle, and hydraulic atomizers configured to atomize a compressed coating material by extruding it from a minute opening.

Rotary atomizers, in general, have a bell-shaped cup at one end of a rotary shaft of its main body as disclosed in Japanese Patent Laid-open Publication JP-H03-101858-A (equivalent to Japanese Patent No. 2600390), for example. A coating material supplied to the bell-shaped cup from a paint supply pipe spreads in form of a thin film along the inner surface of the bell-shaped cup radially outwardly under the centrifugal force, and it is next atomized while flying outwardly from the outer circumferential perimeter of the bell-shaped cup. Then, a shaping airflow drives the atomized coating material forward toward a work to be coated.

A known problem with rotary atomizers is irregularity of the grain size of the atomized coating material. Distribution of grain sizes includes two major peaks, i.e., one peak of a relatively large grain size and the other peak of a relatively small grain size. Irregularity of the grain size of the coating material invites instability of the film quality and degradation of the deposition efficiency of the coating material. This problem is known to occur in spray type atomizers and hydraulic atomizers as well.

SUMMARY OF THE INVENTION

It is therefore an object of the invention to provide an atomizer capable of supplying an atomized coating material uniformed in grain size.

Another object of the invention is to provide an atomizer capable of spraying a coating material without air.

Still another object of the invention is to provide an atomizer capable of easily adjusting the coating pattern of an atomized coating material in size and shape.

Yet another object of the invention is to provide an atomizer capable of atomizing a coating material even under a relatively low rotation speed.

Yet another object of the invention is to provide a spray type atomizer capable of reducing the amount of air discharged from a nozzle together with a coating material.

Yet another object of the invention is to provide an atomizer capable of atomizing a coating material by using a spray type nozzle while removing the need of air.

Yet another object of the invention is to provide a hydraulic atomizer capable of atomizing a coating material even under a relatively low hydraulic pressure.

Yet another object of the invention is to provide an atomizer capable of reducing its optimum distance from a work to assure quality coating on the work.

To accomplish those objects, the present invention is essentially characterized in atomizing a coating material by spattering the coating material into a form easy to atomize from a material spattering means and exerting supersonic vibration onto the coating material just flying from the spattering means. The material spattering means is typically a rotary atomizing head that centrifugally spreads the coating material radially outwardly. Alternatively, the material spattering means may be a paint nozzle used in a conventional spray type atomizer. Alternatively, the material spattering means may be a material discharge opening capable of hydraulic atomization (herein after referred to as a material discharge/hydraulic atomization opening) employed in a conventional hydraulic atomizer.

In case the present invention is applied to an atomizer having a rotary atomizing head, supersonic vibration is preferably exerted forward in a region adjacent to and around the outer circumferential perimeter of the rotary atomizing head to reliably propel the atomized coating material forward with the vibration energy. In case the present invention is applied to an atomizer having a paint nozzle, supersonic vibration is preferably exerted diagonally forward from the area encircling the paint nozzle toward a region adjacent to the paint nozzle to concentrate the vibration energy onto the material just after expelled from the paint nozzle. Similarly, in case the present invention is applied to a hydraulic atomizer, supersonic vibration is preferably exerted diagonally forward from the area encircling the opening toward a region adjacent to a material discharge/hydraulic atomization opening to concentrate the vibration energy onto the material just after expelled from the opening.

Those and other objects, features and advantages of the present invention will become more apparent from the following detailed description of the preferred embodiments in conjunction with the accompanying drawings.

BRIEF DESCRIPTION OF THE DRAWINGS

FIGS. 3A and 3B are diagrams for explaining aspects of atomization of a coating material by using a nozzle of a conventional spray type atomizer without air, in which FIG. 3A shows how a point P as the target of supersonic vibration is determined, and FIG. 3B shows a phenomenon that occurs when the supersonic vibration is concentrated to the point P;

DETAILED DESCRIPTION OF THE INVENTION

Some preferred embodiments and specific examples of the invention will now be explained below in detail with reference to the drawings.

The present invention is applicable to rotary atomizers, spray type atomizers and hydraulic atomizers. These atomizers may be either electrostatic atomizers configured to deposit an electrically charged coating material onto a work held in a ground potential or other type atomizers configured to deposit a non-charged coating material onto a work. Furthermore, the invention is equally usable with any kind of coating materials, including water-based paints, oil-based paints and metallic paints.

Figure 1:
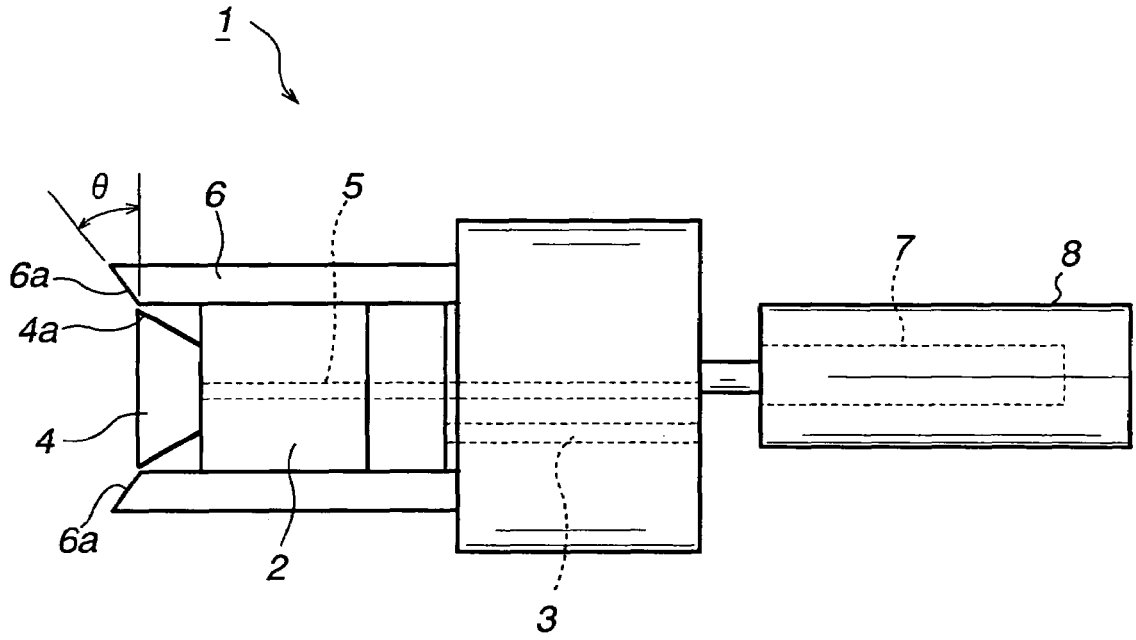
FIG. 1 is a diagram showing an application of the present invention to a rotary atomizer.
Figure 2:
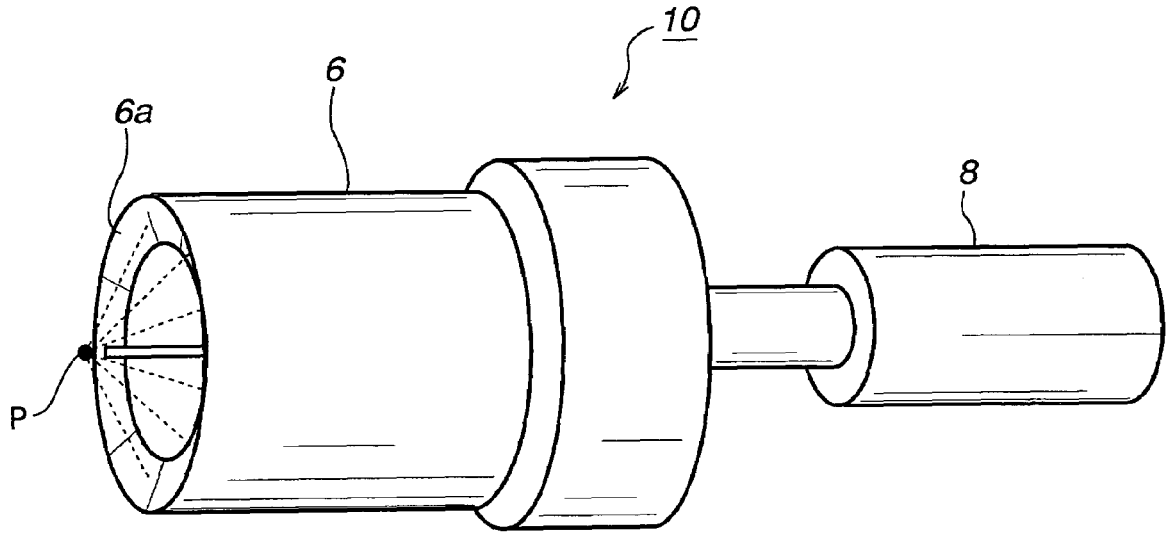
FIG. 2 is a diagram showing an application of the present invention to a spray type or hydraulic atomizer.

FIG. 1 shows an application of the invention to a rotary atomizer. FIG. 2 is an application of the invention to a spray type atomizer or a hydraulic atomizer.

With reference to FIG. 1, the rotary atomizer 1 includes an air motor 2 similarly to conventional atomizers. The air motor 2 rotates with the aid of compressed air supplied through an internal air passage 3, and a rotary atomizing head 4 is driven by the air motor 2. The rotary atomizing head 4 is typically a bell-shaped cup, but it may be disk-shaped. An electric motor may be used instead of the air motor 2. Rotational speeds of bell-shaped cups in conventional rotary atomizers are normally as high as 50,000 rpm to 60,000 rpm. In the rotary atomizer according to the invention, however, rotational speed of the rotary atomizing head 4 may be reduced to as low as 4,000 rpm to 5,000 rpm.

The atomizer 1 further includes an internal paint passage or paint supply pipe 5. A coating material is supplied through the paint supply pipe 5 to a central portion of the rotary atomizing head 4. The coating material having reached the central part of the rotary atomizing head 4 spreads radially outwardly along the surface of the rotary atomizing head 4 under a centrifugal force, and scatters radially outwardly from the outer circumferential perimeter 4*a* of the rotary atomizing head 4. In the region adjacent to the outer circumferential perimeter 4*a* of the rotary atomizing head 4, the coating material is in a condition easy to atomize. More specifically, although it depends upon the feed rate of the coating material and the rotational speed of the rotary atomizing head 4, the coating material spattered from the rotary atomizing head 4 is atomized through the form of a thin layer or a number of filaments.

The rotary atomizer 1 further includes a cylindrical supersonic horn 6 having a vibration plane 6*a* located adjacent to the outer circumferential perimeter 4*a* of the rotary atomizing head 4. More specifically, the vibration plane 6*a* of the supersonic horn 6 is preferably located at a position where it can effectively impart supersonic vibration to the filament-like coating material, film-like coating material or coating material immediately before atomized. The vibration plane 6*a* of the supersonic horn 6 vibrates with supersonic vibration generated by a supersonic generator 7. In FIG. 1, reference numeral 8 denotes an outer case of the supersonic generator 7.

The vibration plane 6*a* of the supersonic horn 6 is an inclined annular plane gradually increasing its diameter forward from its rear end adjacent to the outer circumferential perimeter 4*a* of the rotary atomizing head 4. Thus, the vibration plane 6*a* exerts supersonic vibration to the coating material immediately after departing from the outer circumferential perimeter 4*a* of the rotary atomizing head 4, and can atomize it to particles of a substantially uniform grain size. Simultaneously, the inclined vibration plane 6*a* orients the flying direction of the atomized coating material forward toward a work (not shown).

The rotary atomizing head 4 and the annular vibration plane 6*a* surrounding the rotary atomizing head 4 are preferably adjustable in relative positions in the front-and-rear directions. In a first example, the front-and-rear relative positions of the rotary atomizing head 4 and the vibration plane 6*a* may be determined so that the coating material jumping from the outer circumferential perimeter 4*a* of the rotary atomizing head 4 is exposed to the supersonic vibration from the vibration plane 6*a* without directly contacting the vibration plane 6*a*. In a second example, the front-and-rear relative positions of the rotary atomizing head 4 and the vibration plane 6*a* may be determined so that the coating material exiting from the outer circumferential perimeter 4*a* of the rotary atomizing head 4 forms a thin film on the vibration plane 6*a* and the thin film can be atomized and propelled forward by the supersonic vibration. In a third example, the front-and-rear relative positions of the rotary atomizing head 4 and the vibration plane 6*a* may be determined so that both phenomena explained in the first and second examples occur in combination.

The phenomena explained in the first to third examples undergo influences from the inclination angle θ of the vibration plane 6*a* of the supersonic horn 6. The inclination angle θ of the vibration plane 6*a* is preferably adjustable as desired.

By changing the inclination angle θ of the vibration plane 6*a*, the phenomena explained in the first to third examples and the size of the coating pattern of the coating material can be easily adjusted.

The vibration plane 6*a* of the supersonic horn 6 may be an annular plane continuous in the circumferential direction. Alternatively, it may be formed of a plurality of segments annularly aligned in the circumferential direction, if so desired. In this case, individual segments of the vibration plane 6*a* may be adjustable independently in inclination angle θ and/or front-and-rear position relative to the rotary atomizing head 4. In this manner, the coating pattern of the coating material can be readily adjusted in size and/or shape.

FIG. 2 shows a spray type atomizer 10. The spray type atomizer 10 includes an air-assisted paint nozzle 11 extending toward a work similarly to conventional atomizers. The coating material is in a state easy to atomize at the front end of the nozzle 11, and the coating material is expelled from the nozzle 11 together with air and guided in an atomized form toward the work. The vibration plane 6*a* of the supersonic horn 6 is located behind the nozzle 11. The vibration plane 6*a* orients toward a forward point P adjacent to the front end of the nozzle 11 and lying on the axial line. Thus, the supersonic vibration energy of the vibration plane 6*a* encircling the nozzle 11 is concentrated to the point P. Immediately after the coating material exiting from the nozzle 11, it is atomized to fine particles of a uniform grain size by the supersonic vibration output diagonally forward from the vibration plane 6*a* encircling the nozzle 11. The term "uniform grain size" is herein used when most of the particles of the coating material have a uniform grain size and the particles exhibit a grain size distribution having a single peak.

Figure 3A:
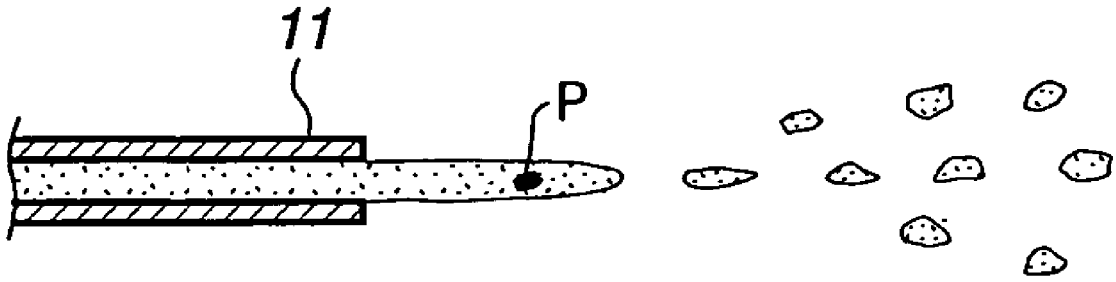
Figure 3B:
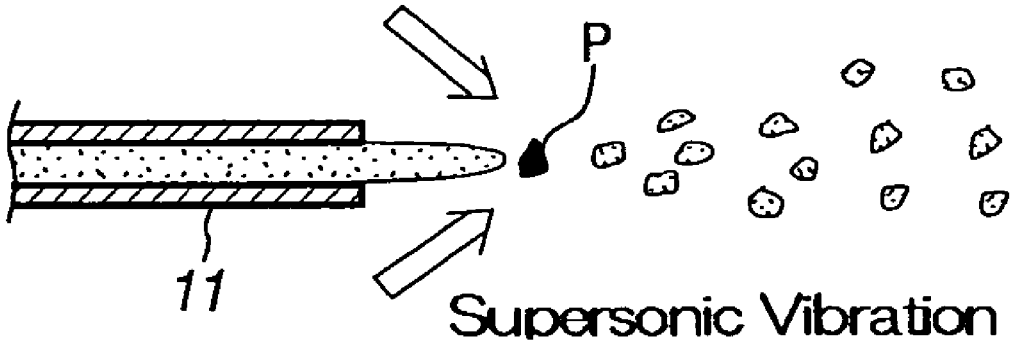

A paint nozzle 11 heretofore used in a conventional spray type atomizer may be used to spatter the coating material without atomizing air, and supersonic vibration may impinge the coating material just after departing the nozzle 11, not assisted by air, to atomize it. This phenomenon is schematically illustrated in FIGS. 3A and 3B. FIG. 3A is a diagram for explaining where to set the point P. FIG. 3B shows the phenomenon appearing when the supersonic vibration energy from the annular vibration plane 6*a* encircling the nozzle 11 is concentrated to the point P lying forwardly adjacent to the nozzle 11 on the axial line.

Although FIG. 2 shows the spray type atomizer 10, it can be modified to a hydraulic atomizer by replacing the nozzle 11 with a material discharge opening capable of hydraulic atomization. As already known, hydraulic atomizers, in general, are configured to atomize a compressed coating material by passing it through a small opening. However, the hydraulic atomizer according to the invention orients supersonic vibration to the point P lying forwardly adjacent to the opening on the axial line. In addition, the hydraulic pressure is set to a value lower than (for example, a value about one part of dozens of fragments of) the hydraulic pressure in a typical conventional atomizer of this type. As a result, the coating material just after expelled from the hydraulic atomization opening is exposed to supersonic vibration and atomized thereby into fine particles of a uniform grain size. The atomization mechanism of the coating material in the hydraulic atomizer according to the present invention is substantially the same as FIG. 3B.

In the atomizer 10 having the nozzle 11 according to the invention, the coating material dashes out of the nozzle 11 with or without atomizing air, and it is next atomized. Similarly, in the atomizer having the hydraulic atomization opening according to the invention, the coating material is expelled from the hydraulic atomization opening in form of a thin film that is easy to atomize, and it is next atomized. The point P mentioned before is preferably determined in the range from the front end of the nozzle 11 or hydraulic atomization opening to the region where the coating material begins to atomize.

In FIG. 2, the same components as those in the rotary atomizer 1 are labeled with common reference numerals. The modified version already explained in conjunction with the rotary atomizer 1 of FIG. 1 is applicable to the spray type atomizer 10 and the hydraulic atomizer as well. Also in the spray type atomizer 10 and the hydraulic atomizer, the vibration plane 6*a* of the supersonic horn 6 may be continuous in the circumferential direction, or it may be composed of a plurality of segments annularly aligned in the circumferential direction. In addition, individual segments of the vibration plane 6*a* may be adjustable independently in inclination angle θ and/or front-and-rear position relative to the rotary atomizing head 4.

Figure 4:
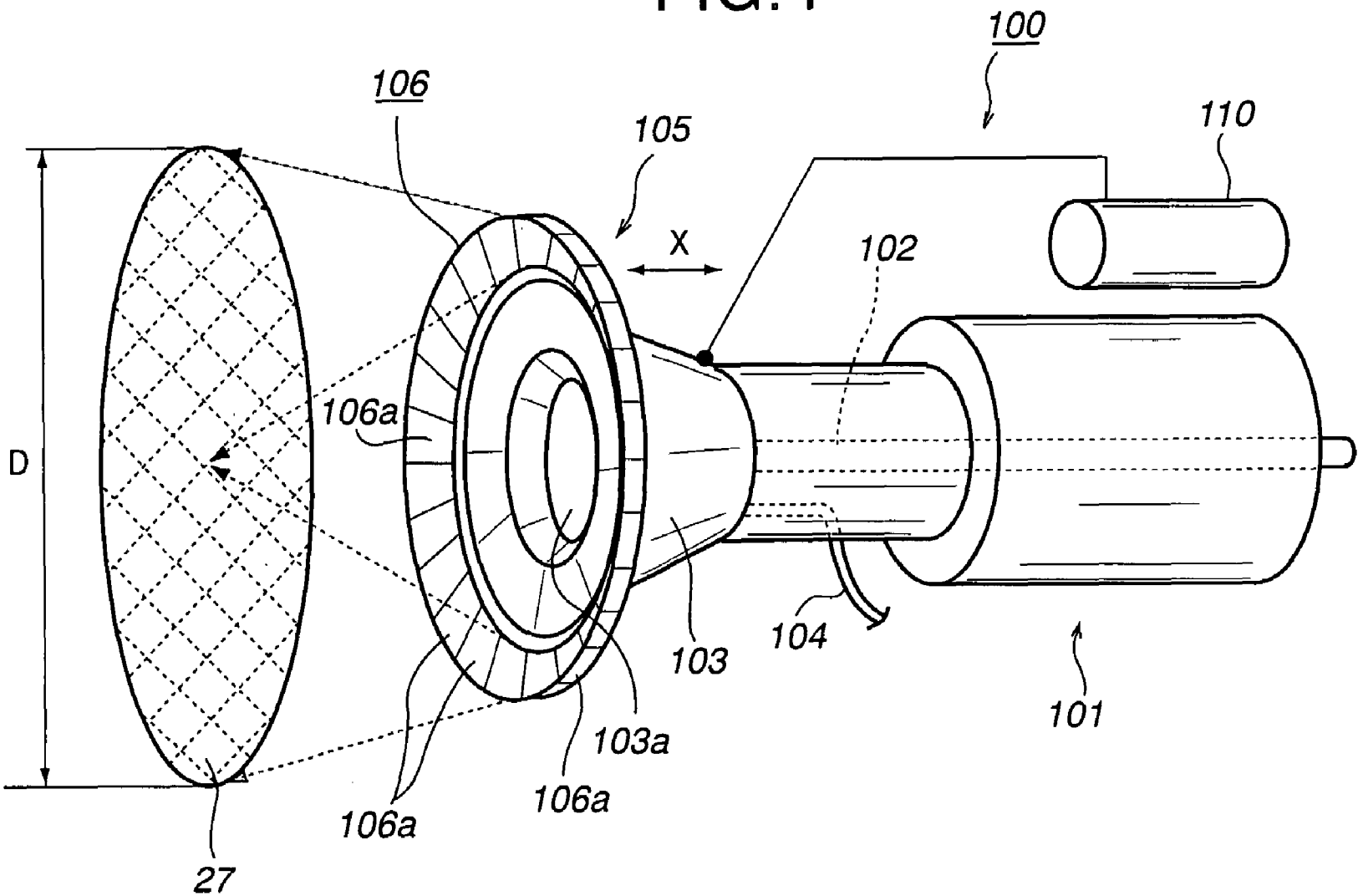
FIG. 4 is a diagram for explaining the structure of a significant part of a rotary electrostatic atomizer according to the first embodiment of the invention.

FIG. 4 is a perspective view schematically showing a rotary electrostatic atomizer 100 according to a further embodiment. Reference numeral 101 denotes the main body of the atomizer 100. The main body 101 includes a rotary shaft 102 rotated by an electric or air-driven motor (not shown). The rotary shaft 102 extends along the axis. A bell-shaped cup 103 is fixed to one end of the rotary shaft 102. The bell-shaped cup 103 is oriented with its open end forward (leftward in FIG. 4) toward a work (not shown).

The rotary electrostatic atomizer 100 may be mounted on a robot arm, for example. The bell-shaped cup 103 can be changed in the front-and-rear direction (the arrow X direction in FIG. 4) and in orientation by moving the robot arm for adjustment of the distance from the work (its surface to be coated) and the orientation with respect to the work. While the bell-shaped cup 103 is driven, the coating material is supplied to the bell-shaped cup 103 from the paint supply pipe 104, and it reaches the inner surface 103*a* of the bell-shaped cup 103 through a plurality of pores formed in a central region of the cup 103. Then, the coating material spreads radially outwardly along the inner surface 103*a* of the cup 103 under the centrifugal force, and then scatters outwardly from the outer circumferential perimeter of the cup 103.

A supersonic vibrator 105 can atomize the coating material by imparting supersonic vibration to the coating material just after flying from the outer circumferential perimeter of the bell-shaped cup 103 that rotates at a relatively low speed (such as 4,000 romp to 5,000 rpm). Moreover, the supersonic vibrator 105 can uniform the grain size of the coating material, and can apply kinetic energy to the coating material to propel the coating material forward.

Figure 5:
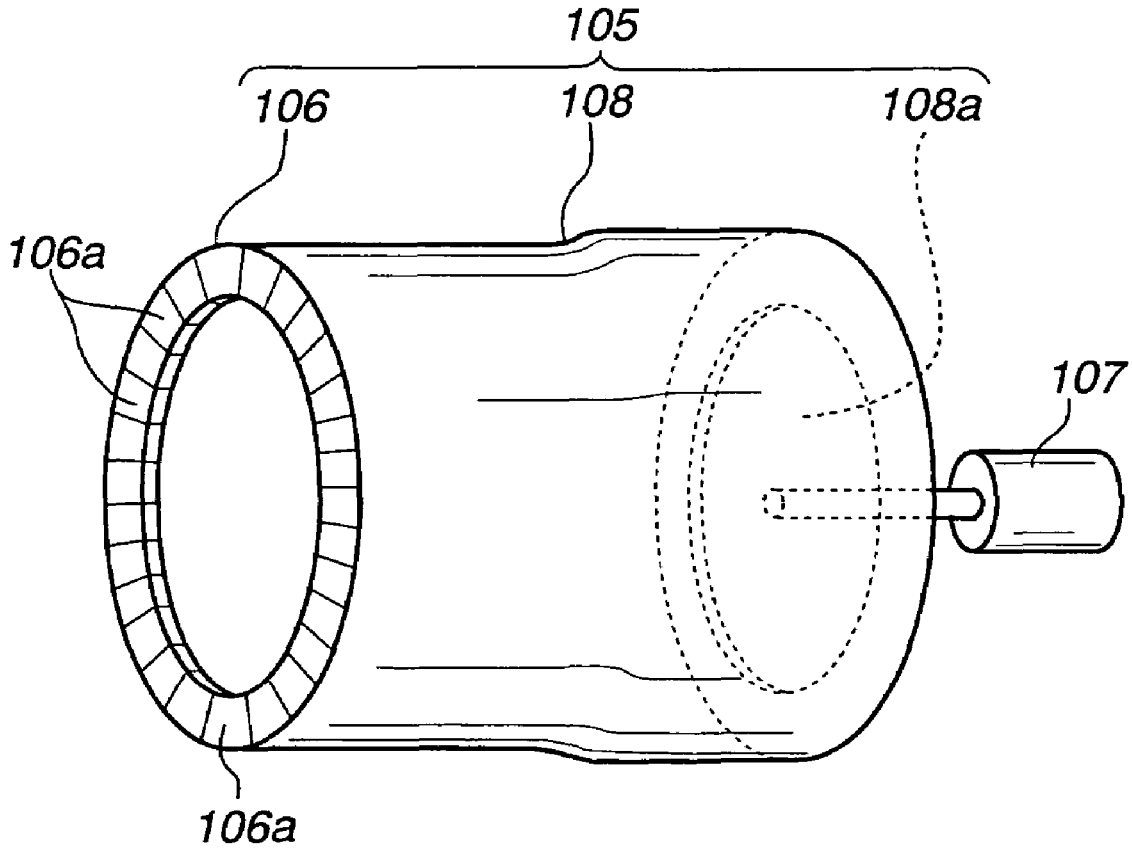
FIG. 5 is a diagram for explaining the structure of a supersonic horn used in the atomizer according to the first embodiment.

The supersonic vibrator 105 may be a supersonic horn having a ring-shaped vibration plane 106 facing forward as shown in FIGS. 4 and 5. The vibration plane 106 shown here is composed of a plurality of segments 106*a* that are aligned annularly in the circumferential direction. The supersonic horn 105 includes a supersonic generator 107 that is connected to a vibration transmission member 108 in form of a cylinder closed at one end. More specifically, the supersonic generator 107 vibrates the center of the bottom plane 108*a* of the vibration transmission member 108, and this vibration is transmitted to the vibration plane 106 through the barrel of the vibration transmission member 108. The use of the supersonic horn 105 of this type makes it possible to locate the supersonic generator 107 apart from the vibration plane 106.

The vibration plane 106 is adjacent to and encircles the outer circumferential perimeter of the bell-shaped cup 103. The vibration plane 106 can move in the front-and-rear direction its positional relation with the bell-shaped cup 103.

The vibration plane 106 can apply supersonic vibration to the coating material immediately after flying outwardly from the outer circumferential perimeter of the bell-shaped cup 103. By controlling the amplitude, frequency, or the like, of the vibration plane 106, it is possible to adjust the level of the kinetic energy applied to the coating material as well as the level of the atomization. As a result, it is possible to improve the adhesion efficiency of the coating material onto the work and the quality of the coating on the work.

The vibration plane 106 is preferably adjustable in inclination angle θ explained before with reference to FIG. 1. As mentioned above, the vibration plane 106 can move together with the bell-shaped cup 103 or can change its orientation together with the bell-shaped cup 103. That is, the vibration plane 106 moves in the front-and-rear direction (the arrow X direction) or changes its orientation together with the bell-shaped cup 103 not to change its positional relation with the bell-shaped cup 103.

The vibration plane 106 is more preferably adjustable both in inclination angle θ and in front-and-read position relative to the bell-shaped cup 103. Thereby, the coating pattern 109 can be adjusted in size and shape as shown in FIG. 4. That is, by adjustment of the inclination angle θ of the vibration plane 106 and/or its font-and-rear position relative to the bell-shaped cup 103, it is possible to adjust the diameter D of the coating pattern 109 and the contour of the coating pattern 109.

Figure 6:
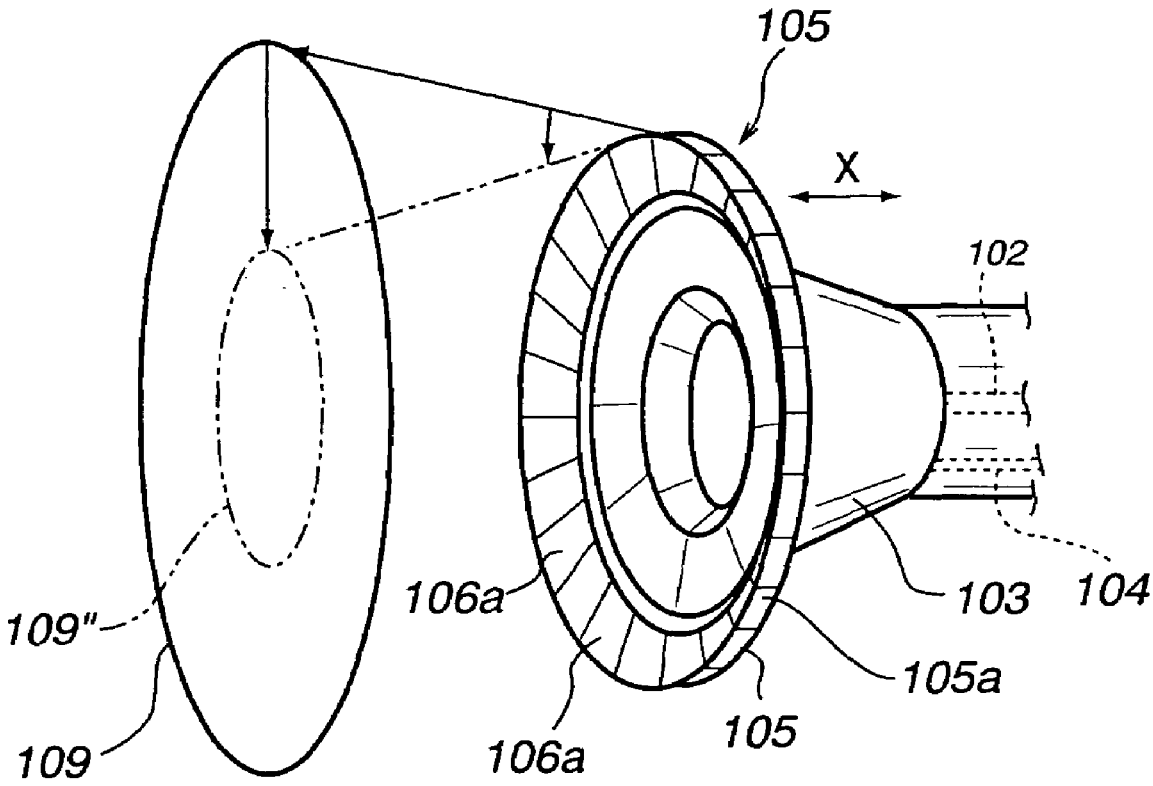
FIG. 6 is a diagram for explaining the relation between a vibration plane around a rotary atomizing head (bell-shaped cup) of the rotary electrostatic atomizer according to the first embodiment and the coating pattern.

FIG. 6 is a diagram illustrating that the contour of the coating pattern 109 varies when the inclination angle θ (see FIG. 1) of the vibration plane 106 adjacent to the outer circumferential perimeter of the bell-shaped cup 103 is adjusted. As indicated with arrows in FIG. 6, if the inclination angle θ of the divergent vibration plane 106 is increased to reduce its opening degree, the contour of the coating pattern 109 becomes smaller. The contour of the coating pattern 109 can be changed also when the positional relation between the vibration plane 106 and the bell-shaped cup 103 is changed in the front-and-rear direction. However, when the font-and-rear relative positions between the vibration plane 106 and the bell-shaped cup 103 is changed, the distribution of the grain size of the coating material changes as well. Therefore, in the actual coating process, adjustment of the inclination angle θ of the vibration plane 106 and adjustment of the front-and-rear positional relation between the vibration plane and the bell-shaped cup 103 are preferably combined to optimize both the distribution of the grain size of the coating material and the coating pattern.

The individual segments 106*a* of the vibration plane 106 are preferably adjustable independently in inclination angle θ and in front-and-rear position relative to the bell-shaped cup 103 independently from each other. In this case, the coating pattern 109 can be controlled in shape and size more freely.

The rotary atomizer 100 has a high-voltage generator 110 to electrically charge the coating material by applying a high voltage from the high-voltage generator 110 to the coating material. In the illustrated example, a high voltage is applied directly to the bell-shaped cup 103. However, any of other various known techniques may be used to electrically charge the coating material. For example, the coating material, after atomized, may be electrically charged by supersonic vibration of the vibration plane 106.

According to the rotary electrostatic atomizer 100 according to the first embodiment explained in conjunction with FIGS. 4 through 6, the coating material spattered from the outer circumferential perimeter of the bell-shaped cup 103, which is driven at a relatively low rotation speed, is immediately exposed to supersonic vibration energy of the annular vibration plane 106. As a result, the coating material is atomized to particles of a uniform grain size. In addition, particles of the coating material receive directional kinetic energy by supersonic vibration of the vibration plane 106 and run forward toward a work.

The above-explained supersonic atomization technique not only enhances atomization of the coating material but also uniforms the grain size of the coating material as compared with conventional electrostatic coating techniques relying on air. For example, the grain size of the coating material is from 30 μm. or even more, in conventional electrostatic coating techniques relying upon air. However, the supersonic atomization technique according to the invention can atomize the coating material to the grain size as small as 20 μm or less. Moreover, the coating material is uniformed in grain size to exhibit a grain size distribution having a single peak. Therefore, the supersonic atomization technique improves the adhesion efficiency of the coating material and its coating quality. Furthermore, the electrostatic coating technique enables easy adjustment of the area and shape of the coating on the work. That is, it permits flexible coating.

Figure 7:
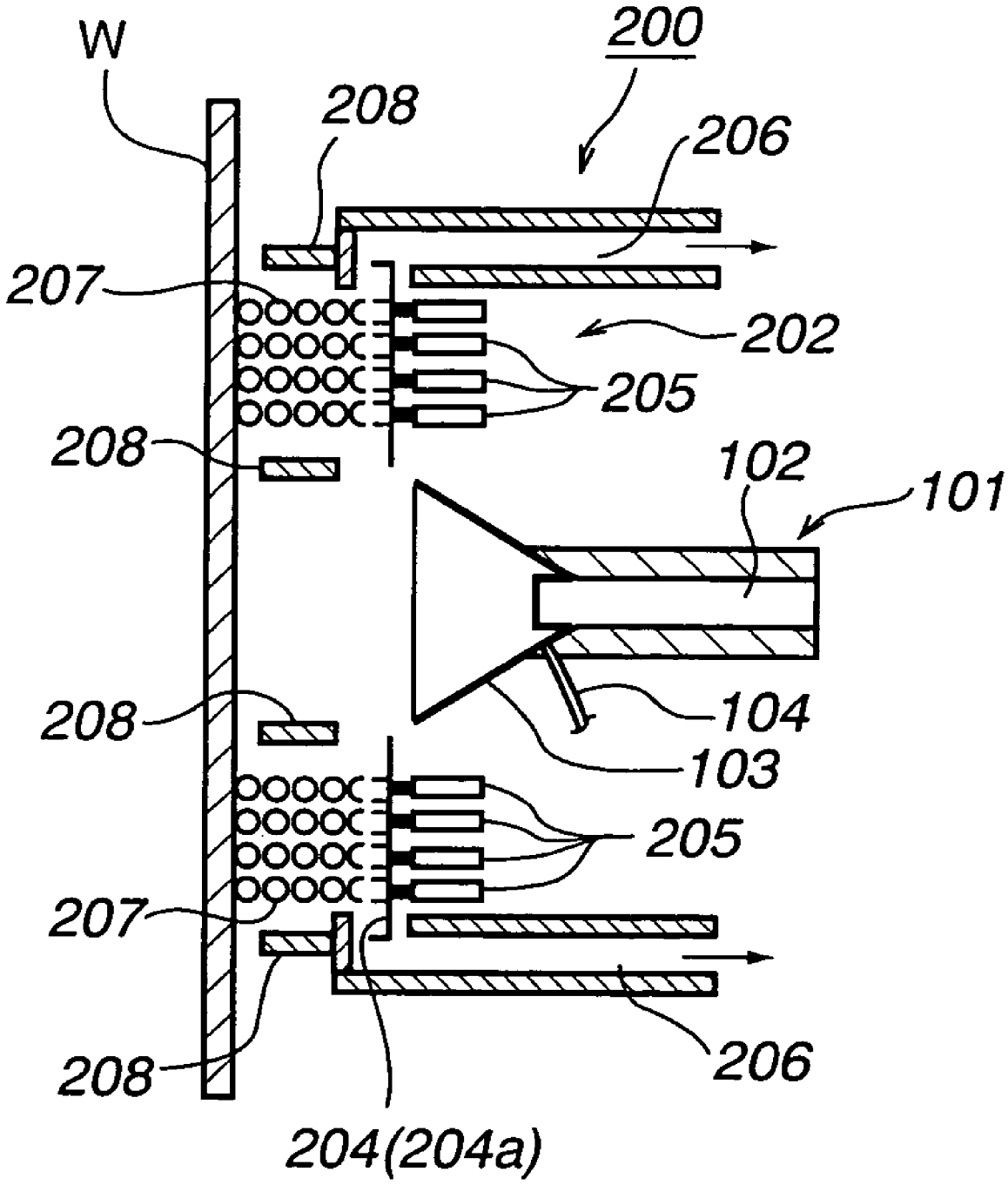
FIG. 7 is a diagram for explaining the structure of a rotary electrostatic atomizer according to the second embodiment of the invention.
Figure 8:
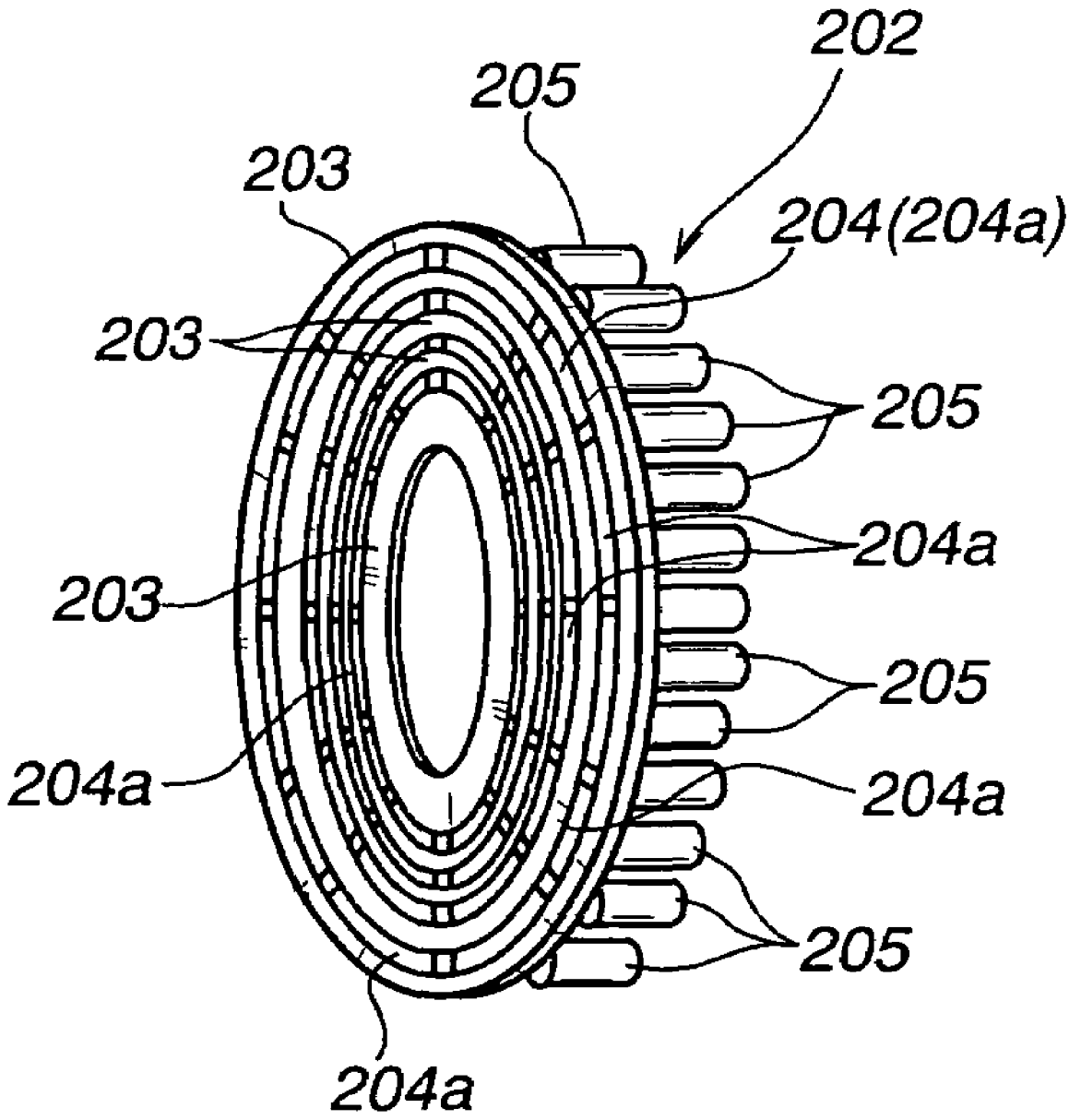
FIG. 8 is a diagram for explaining the structure of a vibrator used in the atomizer according to the second embodiment.

FIGS. 7 and 8 show a rotary electrostatic atomizer 200 according to the second embodiment of the invention. Some of the components in the atomizer shown here are common to some components of the atomizer 100 according to the first embodiment. For simplicity, these common components are labeled with common reference numerals, and their explanation is omitted here.

A supersonic vibrator 202 is located adjacent to the outer circumferential perimeter of the bell-shaped cup 103 to exert supersonic vibration onto the coating material immediately after it scatters from the outer circumferential perimeter of the cup 103.

The supersonic vibrator 202 has a plurality of ring-shaped frames 203 that are concentrically aligned in intervals in the radial direction as shown in FIG. 8 in an enlarged scale. In each interval between every two adjacent ring-shaped frames 203, an annular thin vibration plate 204 spans. Each thin vibration plate 204 may be continuous in the circumferential direction. Preferably, however, it is composed of plural segments 204*a* annularly aligned in the circumferential direction, and supersonic generators 205 are individually connected to the respective segments 204*a*. Thus, the supersonic generators 205 for individual segments 204*a* can be controlled in frequency and amplitude independently from each other to enable more fine adjustment of the size and shape of the coating pattern 109.

The plural ring-shaped frames 203 lie on a plane extending perpendicularly to the axial line of the bell-shaped cup 103. The coating material scattering from the outer circumferential perimeter of the bell-shaped cup 103 is exposed to supersonic vibration from the vibration plates 204 while traveling from radially inner ring-shaped frames to radially outer ring-shaped frames 203. In this process, the supersonic vibration atomizes particles of the coating material to more minute particles, and drives them forward. Reference numeral 206 in FIG. 5 denotes passages 206 for recovery of the coating material that has flied radially outwardly.

FIG. 7 schematically shows how the supersonic vibration energy from the supersonic vibrator 202 propels the particles of the coating material toward a work W. In FIG. 7, reference numeral 207 denotes particles of the coating material atomized by the supersonic vibration.

Reference numeral 208 in FIG. 7 denotes charging electrodes. The charging electrodes 208 are supplied with a high voltage from a high-voltage generator, not shown, to electrically charge the particles 207 of the coating material.

Figure 9:
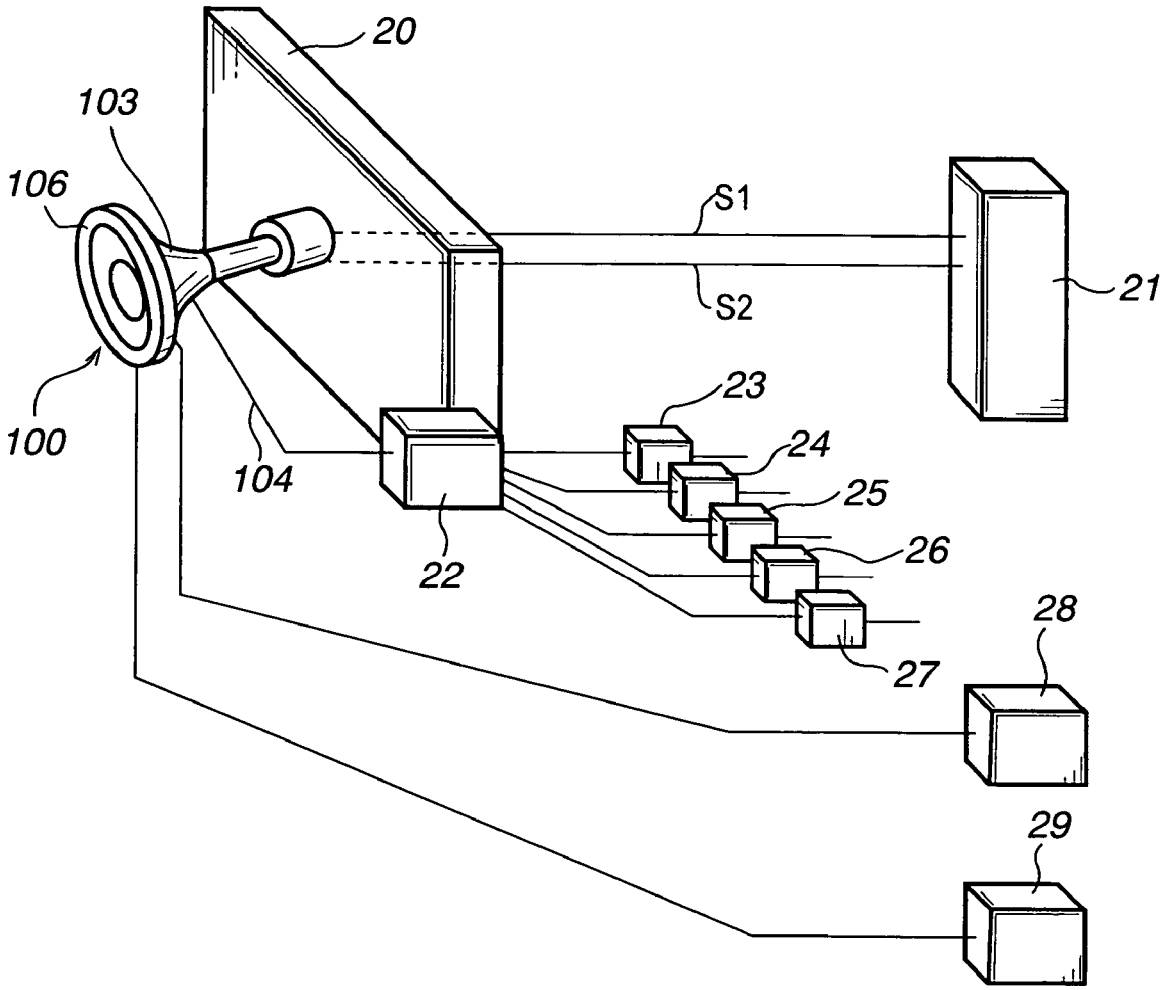
FIG. 9 is a diagram for explaining the entire structure of a coating system including electrostatic atomizers according to an embodiment of the invention, which is suitable for incorporation in a coating line of a car manufacturing process, for example.

FIG. 9 schematically shows a car coating line incorporating the rotary electrostatic atomizer 100 according to the first embodiment, for example. The electrostatic atomizer 100 is set on a traveling device 20 such as a linear motor, robot, or the like. The bell-shaped cup 103 and the vibration plane 106 can swing in all directions.

The rotary electrostatic atomizer 100 is controlled in rotational speed of the air motor, orientation of the bell-shaped cup 103, etc., by control signals S1 and S2 from a main control board 21.

Regarding the supply of the coating material to the rotary electrostatic atomizer 100, a mixer 22 mixes some primary coating materials selected from pumps 23 through 27 containing five primary colors (cyan, magenta, yellow, black and white) respectively, and supplies the mixture to the coating supply pipe 104 (see FIG. 1). Thus, the mixer 22 can mix color paints to produce he coating material of an intended color immediately upstream of the rotary electrostatic atomizer 100.

A supersonic controller 28 controls orientation, etc. of individual segments 106*a* of the vibration plane 106 of the rotary electrostatic atomizer 100. A high-voltage controller 29 controls the high voltage to be generated by the high-voltage generator 110 (see FIG. 4).

The supersonic vibration generator 110 may be any appropriate one of known devices, such as a magnetostriction converter element.

Figure 10:
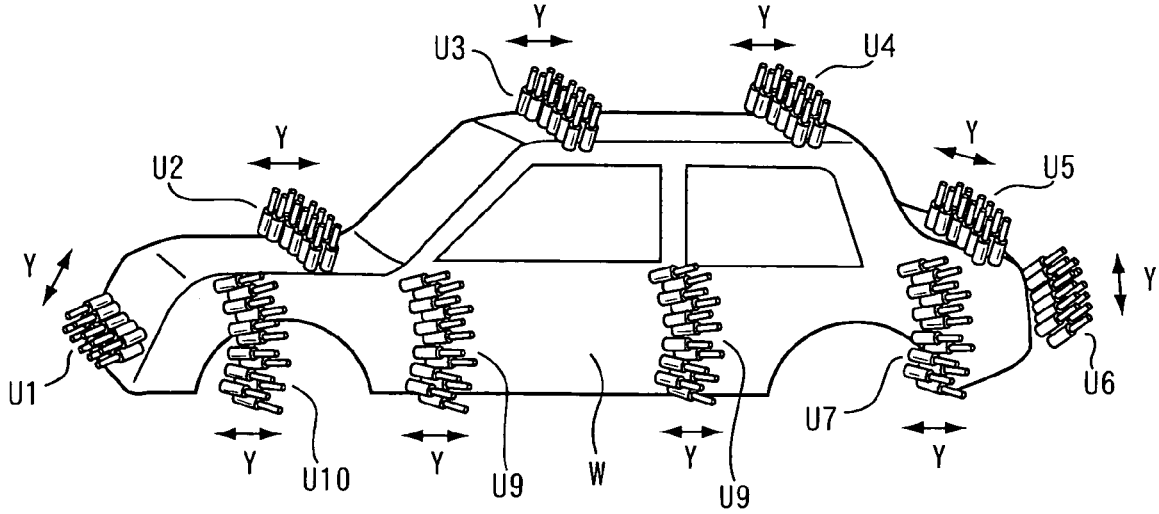
FIG. 10 is a diagram for explaining another coating system including electrostatic atomizers according to an embodiment of the invention, which is suitable for incorporation in a coating line of a car manufacturing process.
Figure 11:
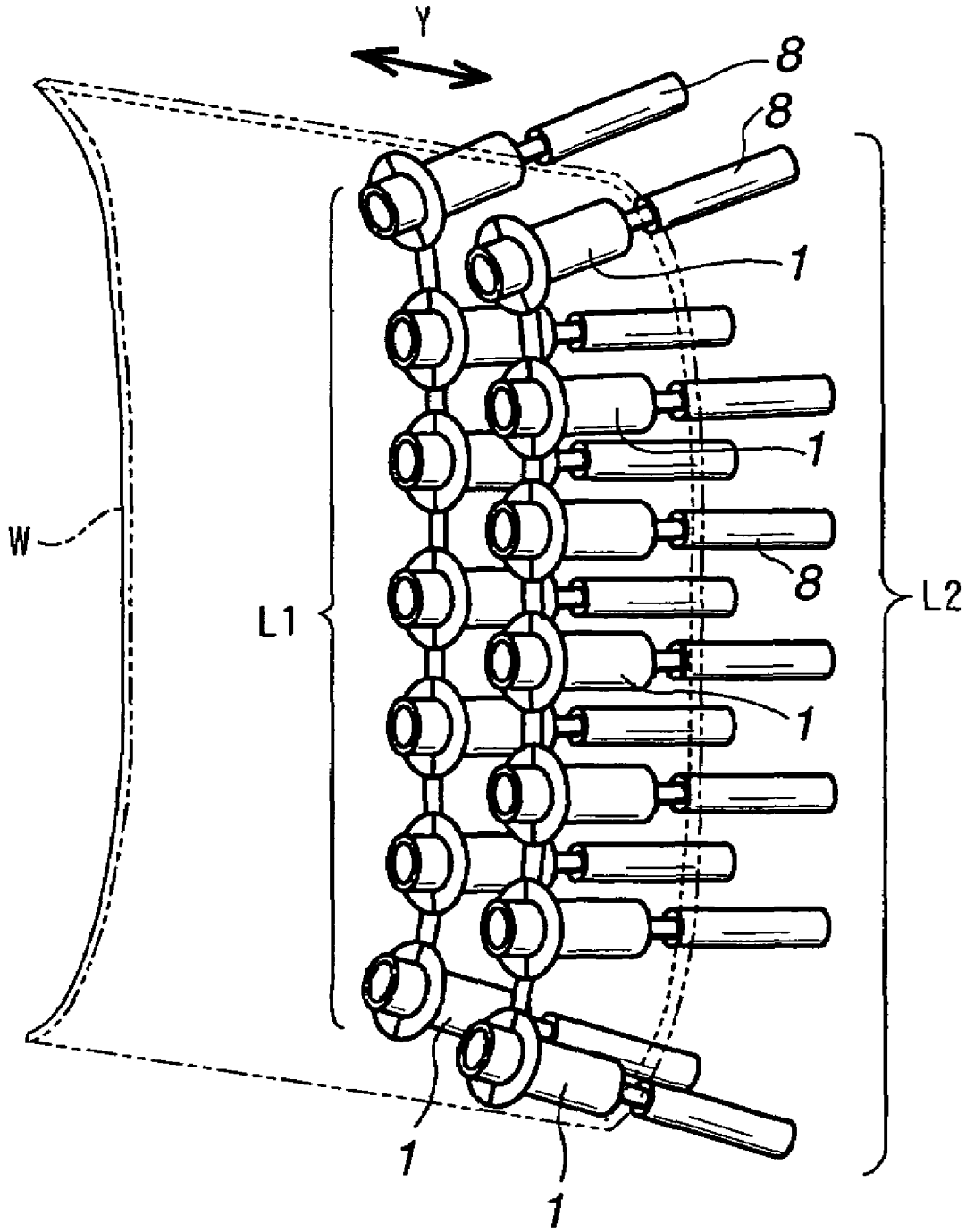
FIG. 11 is a diagram for explaining a unit comprising two lines of electrostatic atomizers used in the coating system shown in FIG. 10.

Next explained are examples of coating on a relatively large work W such as a car body with reference to FIGS. 10 and 11. The rotary electrostatic atomizer shown here is the atomizer 1 shown in FIG. 1. However, the atomizers 10, 100 and 200 shown in FIGS. 2, 4 or 7 are usable in lieu of the atomizer 1.

A plurality of units U1~U10 may be prepared. In each unit U1~U10, a plurality of atomizers 1 may be closely aligned in two lines. The first line L1 and the second line L2 may be parallel to each other. Thus, the units U may be reciprocated (in the arrow Y direction) over the coating surface of the work W to coat the car body W. In this manner, the coating material depositing on the work W can be uniformed in thickness. Preferably, the atomizers 1 of the first line L1 and the atomizers 1 of the second line L2 are arranged in a zigzag layout.

The atomizers forming each unit U may be of any type among various types of atomizers according to the present invention (for example, the rotary atomizers 1 of FIG. 1, spray type atomizers or hydraulic atomizers explained in conjunction with FIG. 2).

The rotary atomizers 1, 100 and 200 do not need air for driving the coating material to the work. In addition, the rotational speed of the rotary atomizing head 4 such as the bell-shaped cup may be relatively low. The atomizer explained with reference to FIG. 2 needs no air or a slight amount of air. In view of these features, the atomizers according to the invention can be located closely to the work W during the coating operation. Conventional rotary atomizers, for example, are located distant by 200~300 mm from the work. In contrast, any atomizer according to the invention may reduce its distance from the work W to 100 mm or less. The shorter the distance from the work W, the adhesion efficiency of the coating material is enhanced, and the voltage required for electrically charging the coating material can be lowered. More specifically, electrostatic machines heretofore located distant in operation need a voltage around 60 kV to 90 kV, but those which can be located as close as 100 mm need a voltage as low as 10 kV to 30 kV.

What is claimed is:

1. A coating method using an atomizer which includes a rotary head driven to rotate by a drive source and includes an annular vibration plane located around the rotary head and exerting supersonic vibration forward, the annular vibration plane being inclined forward from its inner circumferential end adjacent to an outer circumferential perimeter of the rotary head, comprising:

supplying a coating material from a material source through a supply passage to the rotary head under rotation;

centrifugally spattering the coating material radially outwardly from the rotary head; and atomizing the coating material having moved onto the vibration plane from the rotary head by imparting the supersonic vibration from the vibration plane and orienting the coating material forward while the coating material moves radially outwardly along the vibration plane.

2. The coating method according to claim 1, wherein the coating material centrifugally spattered from the rotary head is oriented forward exclusively by the supersonic vibration without the aid of air.

3. The coating method according to claim 1, wherein the coating material spattered radially outwardly from the rotary head moves radially outwardly while forming a thin film on the vibration plane.

4. The coating method of claim 1, wherein said atomizing is by imparting supersonic vibration exerted from an annular vibration plane composed of a plurality of segments annularly aligned in the circumferential direction thereof.

* * * * *